United States Patent [19]

Kozacka et al.

[11] 4,337,452

[45] Jun. 29, 1982

[54] ELECTRIC FUSE HAVING TERMINAL CAPS AND BLADES PROJECTING THROUGH SAID CAPS

[75] Inventors: Frederick J. Kozacka, S. Hampton; Richard A. Belcher, Hampton Falls, both of N.H.

[73] Assignee: Gould Inc., Rolling Meadows, Ill.

[21] Appl. No.: 242,813

[22] Filed: Mar. 11, 1981

[51] Int. Cl.[3] ..... H01H 85/16

[52] U.S. Cl. ..... 337/231; 337/252

[58] Field of Search ..... 337/159, 229, 231, 248, 337/251, 252, 254, 158

[56] References Cited

U.S. PATENT DOCUMENTS

| | | | |
|---|---|---|---|
| 3,465,275 | 9/1969 | Swain | 337/158 |
| 4,245,208 | 1/1981 | Belcher | 337/252 |
| 4,254,394 | 3/1981 | Kozacka | 337/252 |

*Primary Examiner*—George Harris
*Attorney, Agent, or Firm*—Erwin Salzer

[57] ABSTRACT

A blade type fuse whose blades project through the end surfaces of the caps which close the tubular casing. Thus the blade contacts project from the outside of the casing into the inside thereof. There are a plurality of fusible elements inside the casing, all having substantially the same resistance. Some of the fusible elements inside the casing that interconnect the aforementioned blade contacts have a relatively small spacing from the plane defined by the pair of blade contacts. Others of the fusible elements that interconnect the aforementioned blade contacts have a relatively large spacing from the plane defined by the pair of blade contacts. All fusible elements are approximately equally distributed across the cross-section of the casing. This involves for some of the fusible elements a relatively large, and for others of the fusible elements a relatively small, spacing from the plane of the blade contacts to which their ends are attached. To compensate for this difference in spacing the resistance of the connector means is approximately inversely proportional to the spacing of the fusible elements from the plane defined by the pair of blade contacts. Thus the resistance of all fusible elements is equalized, irrespective of their position across the cross-section of the casing of the fuse.

11 Claims, 2 Drawing Figures

ELECTRIC FUSE HAVING TERMINAL CAPS AND BLADES PROJECTING THROUGH SAID CAPS

BACKGROUND OF THE INVENTION

In fuses the casings of which are closed by terminal caps through the end surfaces of which a pair of blade contacts project from the outside of the casing to the inside thereof, the fusible elements must be conductively connected to the pair of blade contacts. There is a limited space on the surfaces of the blade contacts for connecting the fusible elements to them. For this reason the above type of fuses include generally but two fusible elements which have high current ratings, about the same width of the pair of blade contacts, and conductively connect opposite sides of the blade contacts. This type of design results in a current concentration in the planes of surfaces defined by the two fusible elements which, in turn, results in a very poor utilization in regard to its cooling and de-ionization ability of the granular arc-quenching filler inside the casing, since some of the arc-quenching filler is positioned relatively remote from the two fusible elements.

This situation is entirely different from that encountered in plug type fuses, i.e., fuses that are closed by terminal plugs. This type of fuse construction readily permits the increase in the number of fusible elements beyond two, and the distribution of the fusible elements more or less evenly across the cross-section of the casing or fuse tube. This, in turn, results in a far better utilization of the granular filler as far as its cooling and de-ionizing action is concerned.

It is, therefore, the prime object of this invention to provide fuses having blade contacts projecting through the end surfaces of the terminal caps and allowing a more even distribution of the fusible elements across the cross-section of the casing or fuse tube and allowing an increase of the number of fusible elements and a better utilization of the arc-quenching filler for cooling and de-ionization purposes.

Other objects of this invention will become more apparent as this specification proceeds.

SUMMARY OF THE INVENTION

As is apparent from the foregoing, this invention relates to fuses having a tubular casing of electric insulating material, a pulverulent or granular filler inside the casing, a pair of terminal caps closing the casing at the ends thereof, and a pair of blade contacts projecting from the outside of the casing through one of the end surfaces of said terminal caps or ferrules into the inside of the casing. This is made possible by providing each of the end surfaces of the caps of ferrules with a longitudinal slot having the same width as the width of the blade contacts.

The casing of the fuse includes a plurality of fusible elements such as, for instance, six fusible elements. All of the fusible elements have substantially the same resistance, or voltage drop. Some of said fusible elements have a relatively narrow spacing from the plane defined by said pair of blade contacts. Others of said plurality of fusible elements have a relatively wide spacing from the plane defined by said pair of blade contacts. A plurality of pairs of connectors is provided for connecting the ends of each of said plurality of fusible elements to said pair of blade contacts. The resistance of each of said plurality of pairs of connectors is such that the resistance of the current path through each of said plurality of fusible elements is virtually equal, irrespective of the spacing of each of said plurality of fusible elements from the plane defined by said pair of blade contacts. In other words, the resistance of each pair of connectors is roughly, or approximately, inversely proportional to the spacing of each of the plurality of fusible elements from the plane defined by the pair of blade contacts.

DESCRIPTION OF PREFERRED EMBODIMENTS

Figure 1:
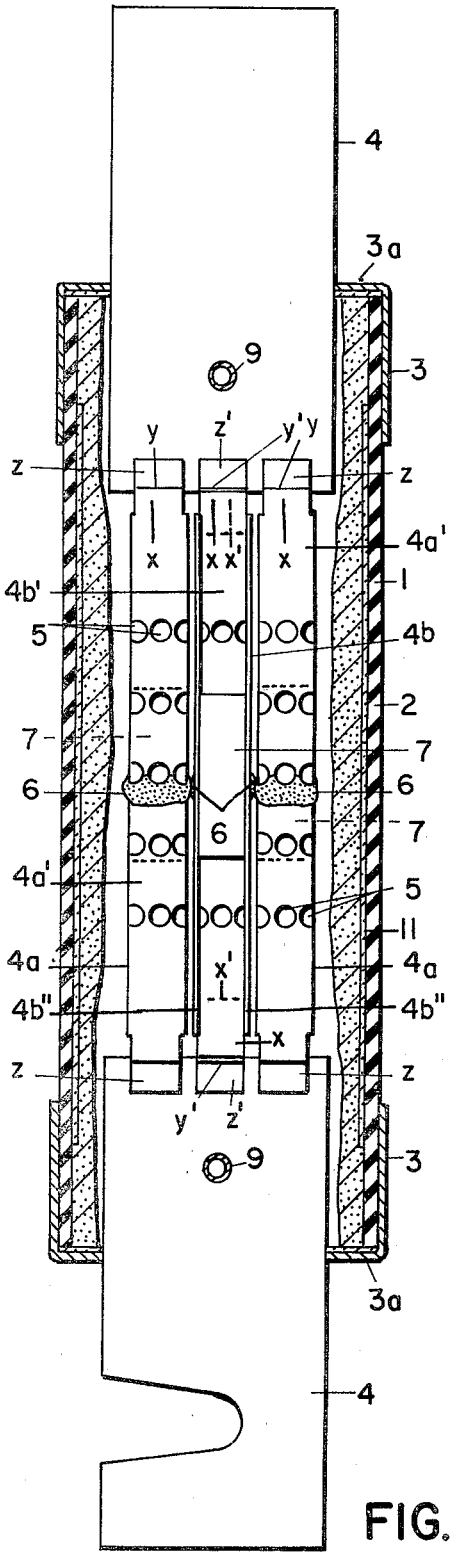
FIG. 1 is generally a longitudinal section of a fuse embodying the present invention some parts being shown in elevation rather than sectionalized.
Figure 2:
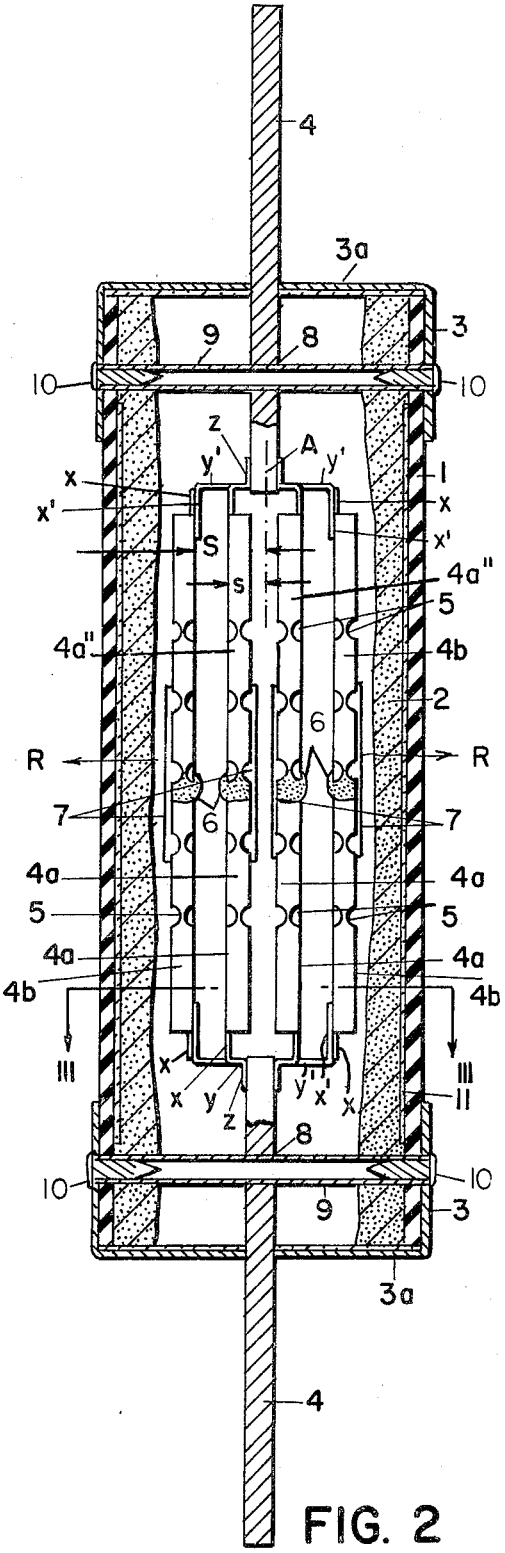
FIG. 2 is a section of the same fuse as shown in FIG. 1, sectioned along a plane at right angles to the plane of FIG. 1 and showing some parts in elevation rather than in section.
Figure 3:
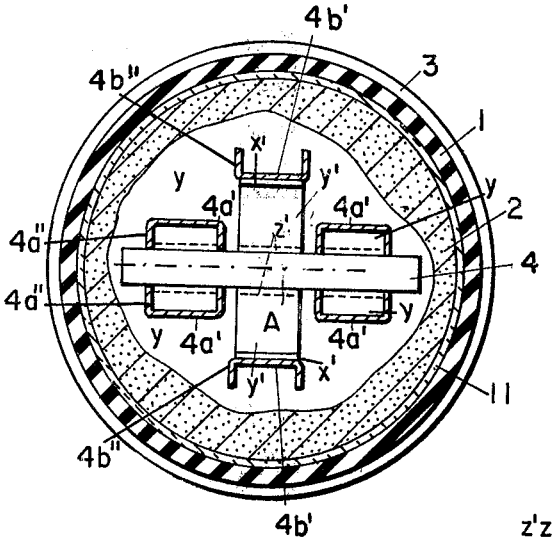
FIG. 3 is a section along III—III of FIG. 2.

Referring now to the drawings, and more particularly to FIGS. 1–3, numeral 1 has been applied to indicate a casing of electric insulating material such as, for instance, a laminate of glass-cloth-melamine. Casing 1 is filled with a pulverulent arc-quenching filler 2, for instance, quartz sand. A pair of terminal caps 3 of metal close casing 1 on the ends thereof. A pair of blade contacts 4 project from the outside of casing 1 through the end surfaces 3*a* of terminal caps 3 into the inside of casing 1. To this end terminal caps 3 are provided with longitudinal slots having the same geometry as the cross-section of blade contacts 4. The casing 1 houses a plurality of fusible elements 4*a*, 4*b* whose ends are conductively connected to blade contacts 4. Fusible elements 4*a*, 4*b* are preferably channel-shaped including web portions and flange portions. Both portions have circular perforations 5 producing serially related points or sections of reduced cross-section.

In the embodiment of the invention shown in FIGS. 1–3 fusible elements 4*a* have a relatively narrow spacing from the plane A defined by the pair of blade contacts 4, and the fusible elements 4*b* have a relatively large spacing from said plane A.

In FIG. 2 reference character s has been applied to indicate the small spacing between plane A and the web portions of fusible elements 4*a* and reference character S has been applied to indicate the large spacing between plane A and the web portions of fusible elements 4*b*, these spacings being measured from the outer surfaces of the web portions of the fusible elements 4*a*, 4*b*.

For an easier understanding of the structure shown in the drawing, reference characters 4*a*′ have been applied to indicate the web portions and reference characters 4a'' have been applied to indicate the flange portions of fusible elements 4a. In like fashion reference characters 4b' have been applied to indicate the web portions and reference characters 4b'' have been applied to indicate the flange portions of fusible elements 4b.

Since the resistance of fusible elements 4a and 4b is about the same, and since the spacing of fusible elements 4a from plane A is less than the spacing of fusible elements 4b from plane A, the requirement that fusible elements 4a and 4b carry substantially the same current calls for connecting means of fusible elements 4a to blade contacts 4 which are of larger ohmic resistance than the connecting means of fusible elements 4b to blade contacts 4. Succinctly restated, the resistance of the connecting means of the fusible elements 4a and 4b must be inversely proportional to their spacing from plane A, or their spacing from blade contacts 4.

The connecting means of fusible elements 4a to blade contacts 4 include the extensions x of their web portions 4a' beyond their flange portions 4a'', horizontal metal strips y and vertical metal strips z.

The connecting means of fusible elements 4b to blade contacts 4 include the extensions x of their web portions 4b' beyond their flange portions 4b'', the metal strips x' in back of their web portions 4b' (see FIG. 2), horizontal metal strips y' and the vertical metal strip z' connected to blade contacts 4 (see FIG. 1).

It follows from the above that the present invention requires that resistance of x, y, z be larger than the resistance of x, x', y', z', or that the resistance of x, x', y', z' be smaller than the resistance of x, y, z.

Reference numeral 6 has been applied in the drawings to indicate M-effect causing overlays arranged around the outer surfaces of channel-shaped fusible elements 4a, 4b near the centers thereof. Overlays 6 have a fusing point lower than the fusing point of the base metal of which fusible elements 4a and 4b are made and sever by a diffusion process fusible elements 4a and 4b well below the fusing points thereof.

Reference numeral 7 has been applied in the drawings to indicate prisms of a solid gas-evolving material which are clamped between the web portions and the flange portions 4a', 4a'', and 4b', 4b'', respectively, of fusible elements 4a and 4b. When breaks are formed by severing of the current path through fusible elements 4a and 4b by overlays 6, the resulting arcs cause evolution of gases from gas-evolving blocks 7. The gases evolved from blocks 7 in fusible elements 4a are opposed to each other, and thus create a state of turbulence which is conducive to rapid extinction of low current arcs. The jets of gases evolved from blocks 7 in fusible elements 4b are of opposite directions, as indicated by the arrows R in FIG. 2. These jets accelerate cooling and de-ionization of the arc products since they increase the speed at which a physical contact takes place between the hot arc products and the cool granular filler 2.

It should be noted that blocks 7 do not require any fasteners for attaching the same to the fusible elements 4a and 4b. The clamping action of the web portions and the flange portions of elements 4a and 4b suffices to secure blocks 7 sufficiently firmly to fusible elements 4a and 4b.

In the drawings reference numeral 11 has been applied to indicate a liner inside of casing 1 intended to reduce the radially outward heat flow. Liner 11 may be omitted if casing 1 is of a material capable of performing this function.

Blade contacts 4 are preferably supported at two points. One of these points is where blade contacts 4 project through the end surfaces 3a of terminal caps or ferrules 3. The other point is where hollow pins 9 project through bores 8 in blade contacts 4. Nail-like fasteners are driven through terminal caps 3 and casing 1 into hollow pins 9 to expand their outer ends.

In FIGS. 4 to 9 the same reference numerals have been applied to indicate like parts as in FIGS. 1-3.

Figure 4:
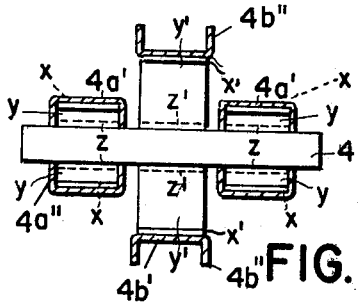
FIG. 4 shows a portion of a fuse structure similar to that shown in FIG. 3 and is a section along IV—IV of FIG. 5.
Figure 5A:
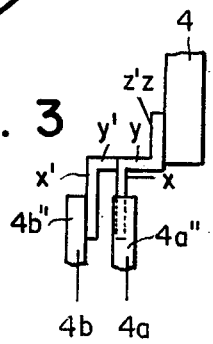
FIG. 5*a* shows the structure of FIG. 5 seen from right to left, or in the direction of arrow G.
Figure 5:
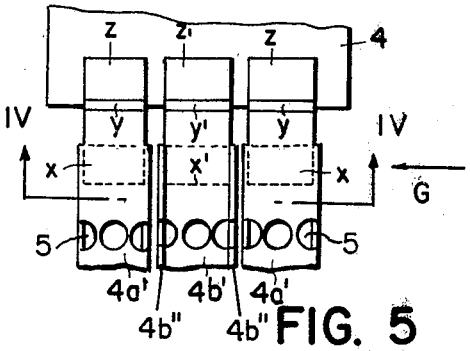
FIG. 5 shows the structure of FIG. 4 in elevation.

The geometry of fusible elements 4a, 4b in FIGS. 4 and 5 is substantially the same as in FIGS. 1 to 3.

As shown in FIGS. 4 and 5 fusible elements 4a and 4b have no ends of the web portions 4a', 4b' which project beyond their flange portions 4a'', 4b''. Fusible elements 4a are conductively connected to blade contacts 4 by angular strips or parts x, y, z. The longer current path of fusible elements 4b relative to that of 4a is compensated by making the resistances of the connectors of fusible elements 4b smaller than the resistances of the connectors of fusible elements 4a. One of these connectors has been shown in side elevation in FIG. 5a. The same figure also shows a side elevation of a connector x', y', z' of fusible element 4b.

Figure 6:
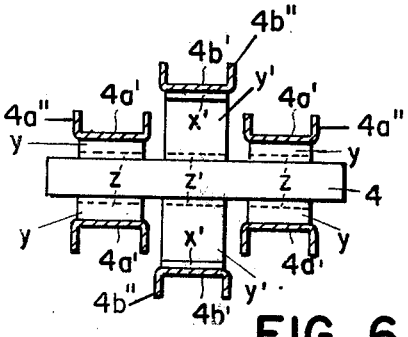
FIG. 6 is a modification of the structure shown in FIGS. 3 and 4 as seen in a section taken along VI—VI of FIG. 7.
Figure 7:
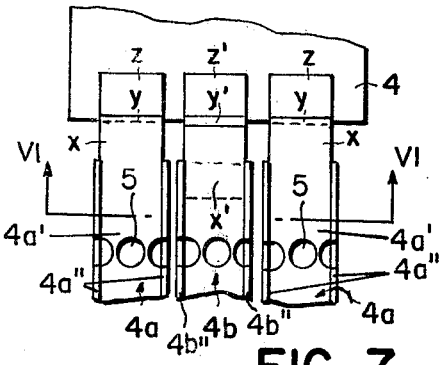
FIG. 7 is a front elevation of the structure shown in FIG. 6.

The structure shown in FIGS. 6 and 7 differs from that shown in FIGS. 4, 5 and 5a in that in the last mentioned structure the channel-shaped fusible elements 4a are turned with their flange portions 4a'' toward blade contacts 4, and the fusible elements 4b being turned with their flange portions 4b'' away from blade contacts 4, while in the structure shown in FIGS. 6 and 7 all the fusible elements 4a and 4b are turned with their flange portions away from blade contacts 4. This has also been shown in FIG. 5a.

According to FIGS. 6 and 7 fusible elements 4a have connectors x, y, z, and fusible elements 4b have connectors x', y', z'. Since the former have to bridge a smaller spacing from blades 4 than the latter, the resistance of x, y, z is larger than that of x', y', z'.

It should further be noted that in the structure of FIGS. 6 and 7 the connector portions x are formed by the web portions 4a' of fusible elements 4a which are extended beyond their flange portions 4a''. In the fusible element 4b an additional tab x' is conductively connected to the web portions 4b' which does not extend beyond flange portions 4b''.

Figure 8:
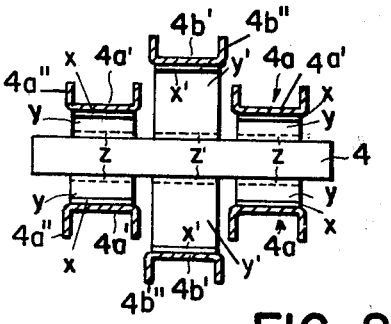
FIG. 8 is a modification of the structure of FIGS. 4 and 6 taken along VIII—VIII of FIG. 9.
Figure 9:
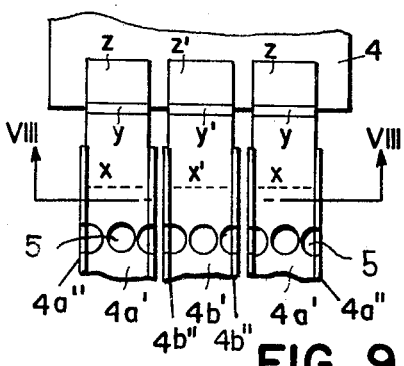
FIG. 9 is an elevational view of the structure shown in FIG. 8.

In the structure of FIGS. 8 and 9 all fusible elements are identical. All are channel-shaped and each has the same cross-sectional area. Substantially Z-shaped connectors x, y, z connect the rear of the webs of fusible elements 4a having relatively short current paths to blade contacts 4. Similar connectors x', y', z' connect the fusible elements 4b to blade contacts 4. Since the length of the current path of fusible elements 4b exceeds that of fusible elements 4a, this must be compensated by making the aggregate resistance of connectors x', y', z' less than the aggregate resistance of connectors x, y, z.

It should be understood that this invention is not limited to the six fusible element configuration shown in FIGS. 1-9. A general idea underlying this invention is to establish in cross-section a more or less circular or elliptical pattern of current paths of which the fusible elements which have a larger spacing from the plane A defined by the blade contacts 4 have connectors of smaller ohmic resistance than the fusible elements which have a smaller spacing from the pair of blade contacts 4. Thus it might, for instance, be thinkable to arrange four fusible elements to each side of the blade contacts 4. Of these fusible elements two pairs would be arranged near the center of the blade contacts, each pair on opposite sides thereof and having a relatively wide spacing from the plane A defined by the pair of blade contacts. The fuse would further include two pairs of fusible elements of which each pair would be arranged close to each edge and at opposite sides of the blade contacts and having a relatively narrow spacing from the plane A defined by the blade contacts.

It will also be apparent from the foregoing that in the preferred embodiment of the invention all of the plurality of fusible elements are arranged in four parallel planes of which two planes are arranged to each side of the plane defined by the letter A. To be more specific, two of these four planes are the planes defined by the web portions 4*a'* and 4*b'* to one side of plane A, and the other two planes of these four planes are defined by the web portions 4*a'* and 4*b'* to the other side of plane A. Some of the fusible elements arranged to different sides of plane A are arranged in different planes such as, for example, fusible elements 4*a* and 4*b*, or their web portions 4*a'* and 4*b'*.

The fuses shown in FIGS. 1–3 are time-lag fuses. The fusion of overlays 6 and the evolution of gas by prismatic blocks 7 involves long periods of time. If the fuses are not needed to interrupt small currents, but only large currents, or short-circuit-like currents, overlays 6 and gas-evolving blocks 7 may be deleted. Even if parts 6 and 7 are deleted, the fuses fulfill the purpose for which they are primarily intended, i.e., to distribute the fusible elements more evenly over the cross-section of the fuse casing, and to increase the number of fusible elements which, in turn, results in a better utilization of the arc-quenching ability of the granular arc-quenching filler.

The channel-shaped cross-section of the fusible elements has a tendency to increase time-lag. However, this tendency may effectively be counteracted by decreasing the thickness of the metal of which the fusible elements are made. Hence fuses having channel-shaped fusible elements are fast, or current-carrying, if the purpose of the channel-shaped cross-section is merely to impart the required stiffness to the fusible elements, i.e., the fusible elements are made of a thin metal, e.g., silver or copper.

We claim as our invention:

1. An electric fuse comprising in combination (a) a tubular casing of electric insulating material;

(b) a pulverulent arc-quenching filler inside said casing;

(c) a pair of terminal caps closing said casing at the ends thereof;

(d) a pair of blade contacts projecting from the outside of said casing through the end surfaces of said pair of terminal caps into the inside of said casing;

(e) a plurality of fusible elements having substantially the same resistance;

(f) some of said plurality of fusible elements having a relatively narrow spacing from the plane defined by said pair of blade contacts, and others of said plurality of fusible elements having a relatively wide spacing from the plane defined by said pair of blade contacts; and (g) a plurality of pairs of connectors for connecting the ends of each of said plurality of fusible elements to said pair of blade contacts, the resistance of each of said plurality of pairs of connectors being such that the resistance of the current path through each of said plurality of fusible elements is virtually equal, irrespective of the spacing of each of said plurality of fusible elements from the plane defined by said pair of blade contacts.

2. An electric fuse as specified in claim 1 wherein each of said pair of connectors includes a pair of parallel spaced metal strips each having an upper end and a lower end, the upper end and the lower end of said pair of metal strips being juxtaposed and conductively interconnected by an intermediate metal strip.

3. An electric fuse as specified in claim 1 wherein (a) each of said plurality of fusible elements is channel-shaped, including a web portion and two flange portions;

(b) said web portions of said plurality of fusible elements are arranged in parallel planes parallel to the plane defined by said pair of blade contacts;

(c) each of said plurality of pairs of connectors is angular and includes two parallel spaced end portions of which one of said end portions is conductively connected to one of said pair of blade contacts and the other of said end portions is conductively connected to said web portion of one of said plurality of fusible elements, and a median portion conductively interconnecting said end portions;

(d) each of said plurality of fusible elements that has a web portion which has a relatively narrow spacing from the plane defined by said pair of blade contacts is connected to said pair of blade contacts by a pair of said connectors which has a relatively high resistance; and (e) each of said plurality of fusible elements that has a web portion which has a relatively wide spacing from the plane defined by said pair of blade contacts is connected to said pair of blade contacts by a pair of connectors which has a relatively low resistance.

4. An electric fuse comprising (a) a tubular casing of electric insulating material;

(b) a pulverulent arc-quenching filler inside said casing;

(c) a pair of terminal caps closing said casing on the ends thereof;

(d) a pair of blade contacts projecting from the outside of said casing through the end surfaces of said pair of terminal caps into the inside of said casing;

(e) a plurality of fusible elements inside said casing having ends conductively connected to said pair of blade contacts;

(f) each of said plurality of fusible elements having substantially the same resistance;

(g) some of said plurality of fusible elements having a relatively narrow spacing from the plane defined by said pair of blade contacts, and others of said plurality of fusible elements having a relatively large spacing from the plane defined by said pair of blade contacts;

(h) connecting means having a relatively small resistance conductively connecting each of said plurality of fusible elements having a relatively wide spacing from the plane defined by said pair of blade contacts to said pair of blade contacts; and (i) connecting means having a relatively high resistance conductively connecting each of said plurality of fusible elements having a relatively narrow spacing from the plane defined by said pair of blade contacts to said pair of blade contacts.

5. An electric fuse as specified in claim 4 wherein said plurality of fusible elements is arranged in four substantially parallel planes, two of said four planes being arranged to opposite sides of the plane defined by said pair of blade contacts and some of the fusible elements arranged to opposite sides of said pair of blade contacts being arranged in spaced planes.

6. An electric fuse as specified in claim 4 wherein said connecting means having a relatively high resistance are integral parts of each of said plurality of fusible elements, and wherein said connecting means having a relatively small resistance are made of parts added to each of said plurality of fusible elements.

7. An electric fuse comprising (a) a tubular casing of electric insulating material;

(b) a pulverulent arc-quenching filler inside said casing;

(c) a pair of ferrules closing the ends of said casing, said pair of ferrules each having an elongated opening in the end surface thereof;

(d) a pair of blade contacts each projecting from the outside of said casing through said opening in said end surface of one of said pair of ferrules into the inside of said casing;

(e) a plurality of fusible elements each having substantially the same resistance;

(f) each of said plurality of fusible elements being channel-shaped each including a web portion and a pair of flange portions, each of said plurality of fusible elements being conductively connected with the web portions thereof to each of said pair of blade contacts, a first portion of said plurality of fusible elements having the web portion thereof arranged in a plane relatively close to the plane defined by said pair of blade contacts, and a second portion of said plurality of fusible elements having the web portion thereof arranged in a plane relatively remote from the plane defined by said pair of blade contacts;

(g) strip connectors for conductively connecting said web portions to said pair of blade contacts, said strip connectors including a first arm substantially coplanar with said web portions, a second arm at right angles to said web portions, and a third arm substantially parallel to the plane defined by said pair of blade contacts; and (h) said strip connectors conductively connecting said second portion of said fusible elements to said pair of blade contacts having a lower resistance than said strip connectors conductively connecting said first portion of said fusible elements to said pair of blade contacts.

8. An electric fuse comprising (a) a tubular casing of electric insulating material;

(b) a pair of terminal caps closing the ends of said casing;

(c) each of said pair of terminal caps having an oblong slot in one of the end surfaces thereof;

(d) a pair of blade contacts each projecting through one of said pair of terminal caps from the outside of said casing to the inside thereof;

(e) a plurality of pairs of parallel fusible elements each having a predetermined resistance arranged to opposite sides of said pair of blade contacts and having ends conductively connected to said pair of blade contacts and arranged relatively close to the general plane defined by said pair of blade contacts;

(f) an additional pair of parallel fusible elements each having the same predetermined resistance as one of said plurality of fusible elements, and each of said additional pair of fusible elements being arranged to opposite sides of said pair of blade contacts and having ends conductively connected to said pair of blade contacts and arranged relatively remote from the general plane defined by said pair of blade contacts;

(g) first means for conductively connecting the ends of said plurality of fusible elements to said pair of blade contacts, and second means for conductively connecting the ends of said additional pair of fusible elements to said pair of blade contacts, each of said second connecting means having a lower ohmic resistance than each of said first connecting means; and (h) a pulverulent arc-quenching filler inside said casing immersing said plurality of pairs of fusible elements and said additional pair of fusible elements.

9. An electric fuse as specified in claim 8 wherein (a) each of said plurality of pairs of fusible elements and each of said additional pair of fusible elements are channel-shaped and comprise a web portion arranged parallel to the plane defined by said pair of blade contacts and two flange portions;

(b) each fusible element of each of said plurality of pairs of fusible elements and each fusible element of each of said additional pair of fusible elements is arranged to opposite sides of the plane defined by said pair of blade contacts;

(c) said additional pair of fusible elements is arranged in the center of said pair of blade contacts relatively remote from the plane defined by said pair of blade contacts and connected to said pair of blade contacts by connecting means having a relatively low ohmic resistance; and wherein (d) said plurality of fusible elements comprises two pairs of fusible elements, one pair of said two pairs being arranged to one side and the other pair of said two pairs being arranged to the other side of said additional pair of fusible elements and connected to said pair of blade contacts by connecting means having a relatively high ohmic resistance.

10. An electric fuse as specified in claim 9 wherein (a) a prismatic block of solid gas-evolving material is clamped between the flange portions and the web portions of each of said plurality of pairs of fusible elements, and a prismatic block of solid gas-evolving material is clamped between the flange portions and the web portions of each of said additional pair of fusible elements; and (b) an M-effect causing overlay is provided on each of said plurality of pairs of fusible elements and on each of said additional pair of fusible elements near the center of said blocks of gas-evolving material.

11. An electric fuse comprising (a) a tubular casing of electric insulating material;

(b) a pair of terminal caps closing the ends of said casing;

(c) each of said pair of terminal caps having an oblong slot in one of the end surfaces thereof;

(d) a pair of blade contacts each projecting through one of said slots from the outside of said casing into the inside thereof;

(e) a plurality of fusible elements arranged symmetrically to opposite sides of the plane defined by said pair of blade contacts, each of said plurality of fusible elements having substantially the same resistance;

(f) the spacing of each of said plurality of fusible elements from the plane defined by said pair of blade contacts varying between contiguous fusible elements;

(g) means for conductively connecting the ends of said plurality of fusible elements to the axially inner ends of said pair of blade contacts, said means having a relatively large resistance for the portion of said fusible elements having a relatively small spacing from the plane defined by said pair of blade contacts, and said means having a relatively small resistance for the portion of said fusible elements having relatively large spacing from the plane defined by said pair of blade contacts so that the current path of each of said plurality of fusible elements has a substantially equal ohmic resistance irrespective of the spacing of each of said plurality of fusible elements from the plane defined by said pair of blade contacts; and (h) a pulverulent arc-quenching filler inside said casing immersing said plurality of fusible elements.

* * * * *